US007703210B2

(12) United States Patent
Lau

(10) Patent No.: US 7,703,210 B2
(45) Date of Patent: Apr. 27, 2010

(54) BLADE DRIVING ASSEMBLY FOR AN ADJUSTABLE HAIR CLIPPER

(75) Inventor: Tung Yan Lau, N.T. (HK)

(73) Assignee: Specialife Industries Limited, N.T. Hong Kong (HK)

( * ) Notice: Subject to any disclaimer, the term of this patent is extended or adjusted under 35 U.S.C. 154(b) by 170 days.

(21) Appl. No.: 11/954,188

(22) Filed: Dec. 11, 2007

(65) Prior Publication Data

US 2009/0144988 A1 Jun. 11, 2009

(51) Int. Cl.
*B26B 19/20* (2006.01)

(52) U.S. Cl. ..... 30/201; 30/196

(58) Field of Classification Search ..... 30/196, 30/197, 200, 201, 208
See application file for complete search history.

(56) References Cited

U.S. PATENT DOCUMENTS 5,325,589 A * 7/1994 Kubo ..... 30/201
5,367,772 A * 11/1994 Ogawa ..... 30/201
6,260,276 B1 * 7/2001 Lebherz et al. ..... 30/201
6,742,262 B2 * 6/2004 Rizzuto et al. ..... 30/201
7,234,242 B2 * 6/2007 Yao ..... 30/201
2005/0044718 A1 * 3/2005 Nakakura et al. ..... 30/196
2007/0044320 A1 * 3/2007 Fukutani et al. ..... 30/201
2008/0168661 A1 * 7/2008 Lau ..... 30/216

* cited by examiner

*Primary Examiner*—Hwei-Siu C Payer

(57) ABSTRACT

A blade driving assembly for an adjustable hair clipper of the present invention comprises a movable blade holder, a spring, a spring holder and a push lever. The spring is disposed with a coiled portion secured on the spring holder, a first portion which exerts pressure upon the movable blade holder to bias the movable blade towards the stationary blade and a second portion which biases the spring holder towards a retracted position. The push lever is driven to move forward or backward by an external force, and a front end of the push lever abuts against the rear end of the spring holder in such a way to push the spring holder forward when the push lever is driven forward, and when the push lever is driven backward, the spring holder is biased by the spring to retract until the rear end thereof abuts against the push lever.

6 Claims, 5 Drawing Sheets

BLADE DRIVING ASSEMBLY FOR AN ADJUSTABLE HAIR CLIPPER

BACKGROUND OF THE INVENTION

The present invention relates to a blade driving assembly for an adjustable hair clipper and more particularly pertains blade driving assembly for driving the movable blade of a hair clipper to move laterally relative to the stationary blade in a reciprocating manner to cut the hairs and longitudinally to adjust the cut length of hairs.

Conventional hair clippers are usually provided with a movable blade driven by a blade driving assembly to reciprocate laterally relative to a stationary blade in an operative condition. The movable blade is fastened to a movable blade holder and the movable blade holder is provided with a fastening slot which engages with an eccentric pin driven by a motor to drive the movable blade holder and the movable blade to move in a lateral reciprocating manner. A torsion spring is usually provided to exert pressure upon the movable blade holder to bias the movable blade towards the stationary blade on one hand, and to control the movable blade holder to move forward or backward to adjust the cut length of hairs. The torsion spring is engaged with the movable blade holder by hooking the front ends of the torsion spring into respective recesses provided on the movable blade holder. When a user pushes the adjustment knob on the hair clipper forward, the torsion spring is driven to move forward and thereby driving the movable blade holder to move forward.

However, the use of torsion spring to drive the forward and backward movements of the movable blade holder makes it very difficult to achieve accurate adjustment of cut length of hairs. To achieve accurate adjustment of cut length of hairs, one possible way is to use high quality torsion springs with consistent tensility but such torsion springs are relatively expensive. Furthermore, torsion springs are easily susceptible to deformation, fatigue and other problems after prolonged usage, and so it would be difficult for conventional hair clippers to ensure accurate adjustment of the cut length of hairs after a period of time.

BRIEF SUMMARY OF THE INVENTION

In view of the aforesaid disadvantages now present in the prior art, the object of the present invention is to provide a blade driving assembly for an adjustable hair clipper which ensures accurate adjustment of cut length of hairs yet is of simple structure and low manufacturing costs.

To attain this, the blade driving assembly for an adjustable hair clipper of the present invention has a movable blade driven by the blade driving assembly to reciprocate laterally relative to a stationary blade in an operative condition, wherein the blade driving assembly comprises a movable blade holder, a spring means, a spring holder and a push lever. The movable blade holder is fastened to the movable blade and disposed with a fastening slot, and the fastening slot engages with an eccentric pin driven by a motor to drive the movable blade holder and the movable blade to move in a lateral reciprocating manner. The spring means is disposed with a coiled portion secured on the spring holder, a first portion which exerts pressure upon the movable blade holder to bias the movable blade towards the stationary blade and a second portion which biases the spring holder towards a retracted position. The spring holder is disposed with a connecting means at a front end thereof and a securing means at a rear end thereof for securing the coiled portion of the spring means, and the connecting means interlocks with the movable blade holder in such a way to allow the movable blade holder to move in a lateral reciprocating manner. The push lever is driven to move forward or backward by an external force, and a front end of the push lever abuts against the rear end of the spring holder in such a way to push the spring holder forward when the push lever is driven forward, and when the push lever is driven backward, the spring holder is biased by the spring means to retract until the rear end thereof abuts against the push lever.

The connecting means of the spring holder comprises a driving shaft, a pair of through holes arranged at the front end of the spring holder for receiving a middle portion of the driving shaft, a locking tab with its front end abutting against an underside of the driving shaft and its rear end fastened to the spring holder at a position rear to the pair of through holes, and a pair of hooked sections disposed at the rear end of the movable blade holder for receiving the driving shaft with the pair of through holes disposed therebetween in a way which allows the movable blade holder to move in a lateral reciprocating manner along the driving shaft.

The securing means of the spring holder comprises a rod fastened thereto and through which the coiled portion of the spring means extends.

The spring means is a torsion spring, and the coiled portion takes the form of a pair of coiled portions, and the first portion of the spring means is formed by two segments each extending from outer ends of the coiled portions. In one preferred embodiment, two slots are disposed on an upper surface of the movable blade holder for receiving the two segments forming the first portion of the spring means thereon respectively. The second portion of the spring means is formed by two segments each extending from inner ends of the coiled portions and a joined segment joining the two segments, and a stopper is disposed rear to the movable blade holder at a fixed position relative to the stationary blade which cooperates with the joined segment to bias the spring holder towards a retracted position.

A plurality of supporting ribs are provided underneath the spring holder to support forward and backward movements of the spring holder.

The present invention operates as follows:

When the blade driving assembly is at a default position, due to the biasing force exerted by the second portion of the spring means, the spring holder is fixed at a retracted position.

If the user wishes to increase the cut length of hairs, the user pushes an adjustment knob on the hair clipper forward which in turn drives the push lever to move forward. The forward driving force of the push lever offsets the biasing force of the second portion of the spring means so that the spring holder is driven to move forward. The movable blade holder and the movable blade are also driven to move forward by the connecting means of the spring holder.

If the user wishes to reduce the cut length of hairs, the user pulls the adjustment knob on the hair clipper backward which in turn drives the push lever to move backward. The biasing force of the second portion of the spring means drive the spring holder to retract until the rear end of the spring holder abuts against the push lever. The movable blade holder and the movable blade are thereby driven to move backward by the connecting means of the spring holder.

The torsion spring of the present invention functions is not responsible for the forward and backward movements of the movable blade holder. Instead, the forward and backward movements of the movable blade holder are driven by the linear mechanical movements of the push lever and the spring holder. It is therefore possible to ensure accurate adjustment of the cut length of hairs.

Further objects, features, and advantages of the invention will become more apparent from the following description and the appended claims with reference to the accompanying drawings, all of which form a part of this specification. It should be understood, however, that the description and the specific example(s) while representing the preferred embodiment(s) are/is given by way of illustration only.

DETAILED DESCRIPTION OF THE INVENTION

Figure 1:
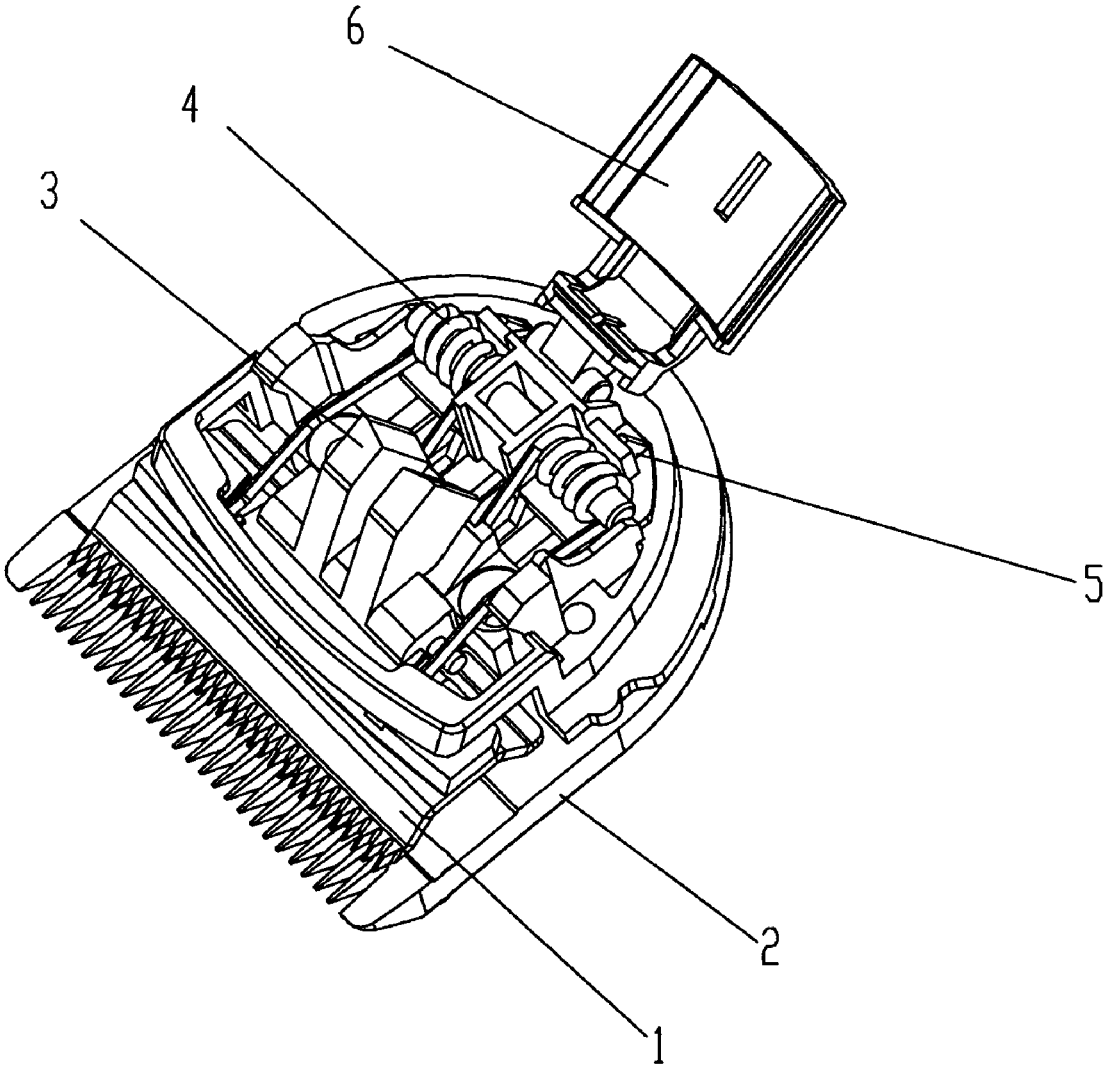
FIG. 1 is a perspective view of the blade driving assembly of the present invention.

The present invention is further described in detail with the following embodiment and the accompanying drawings. As illustrated in FIG. 1, the blade driving assembly for an adjustable hair clipper of the present invention has a movable blade 1 driven by the blade driving assembly to reciprocate laterally relative to a stationary blade 2 in an operative condition. The blade driving assembly comprises a movable blade holder 3, a spring means 4, a spring holder 5 and a push lever 6.

Figure 2:
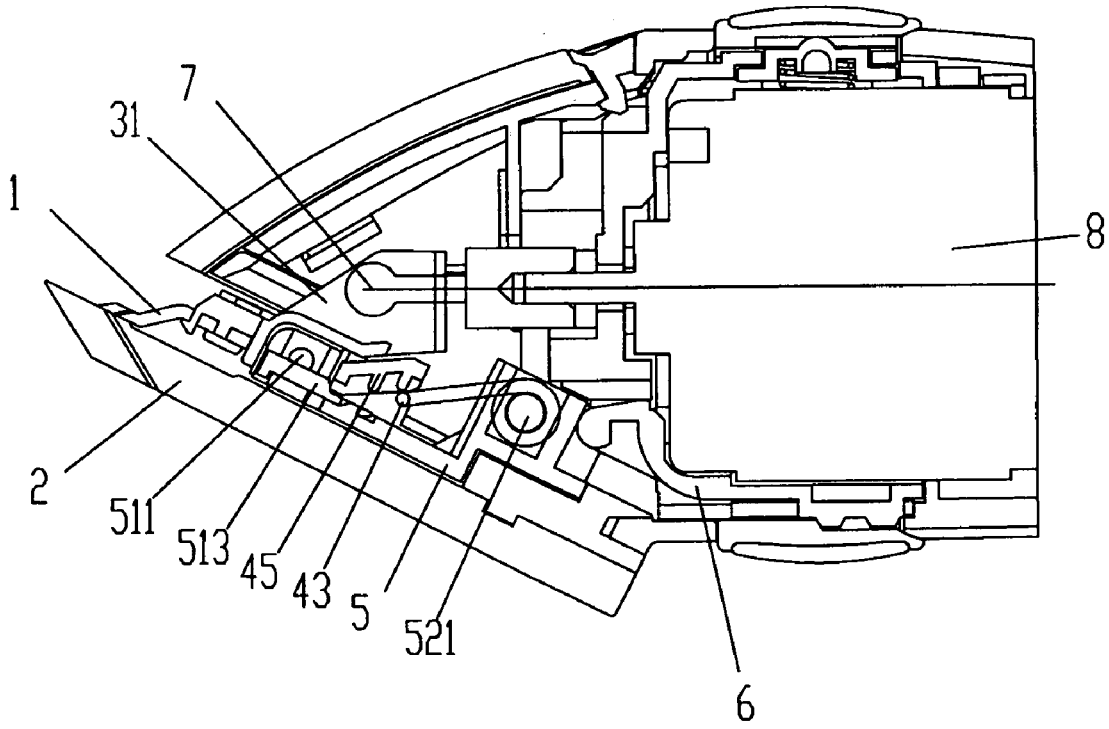
FIG. 2 is a cross sectional view of the present invention.
Figure 3:
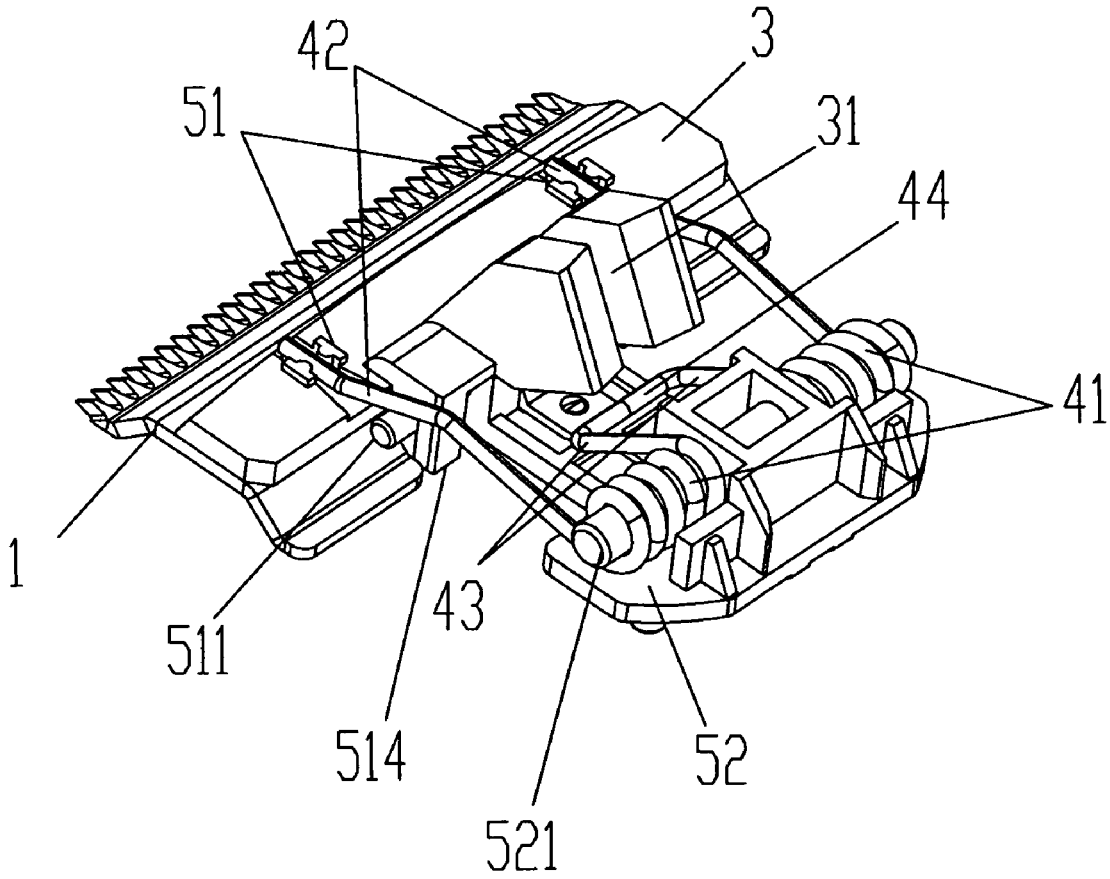
FIG. 3 is a further perspective view showing some of the components of the blade driving assembly of the present invention.

As illustrated in FIGS. 1 to 3, the movable blade holder 3 is fastened to the movable blade 1 and disposed with a fastening slot 31. The fastening slot 31 engages with an eccentric pin 7 driven by a motor 8 to drive the movable blade holder 3 and the movable blade 1 to move in a lateral reciprocating manner.

Figure 4:
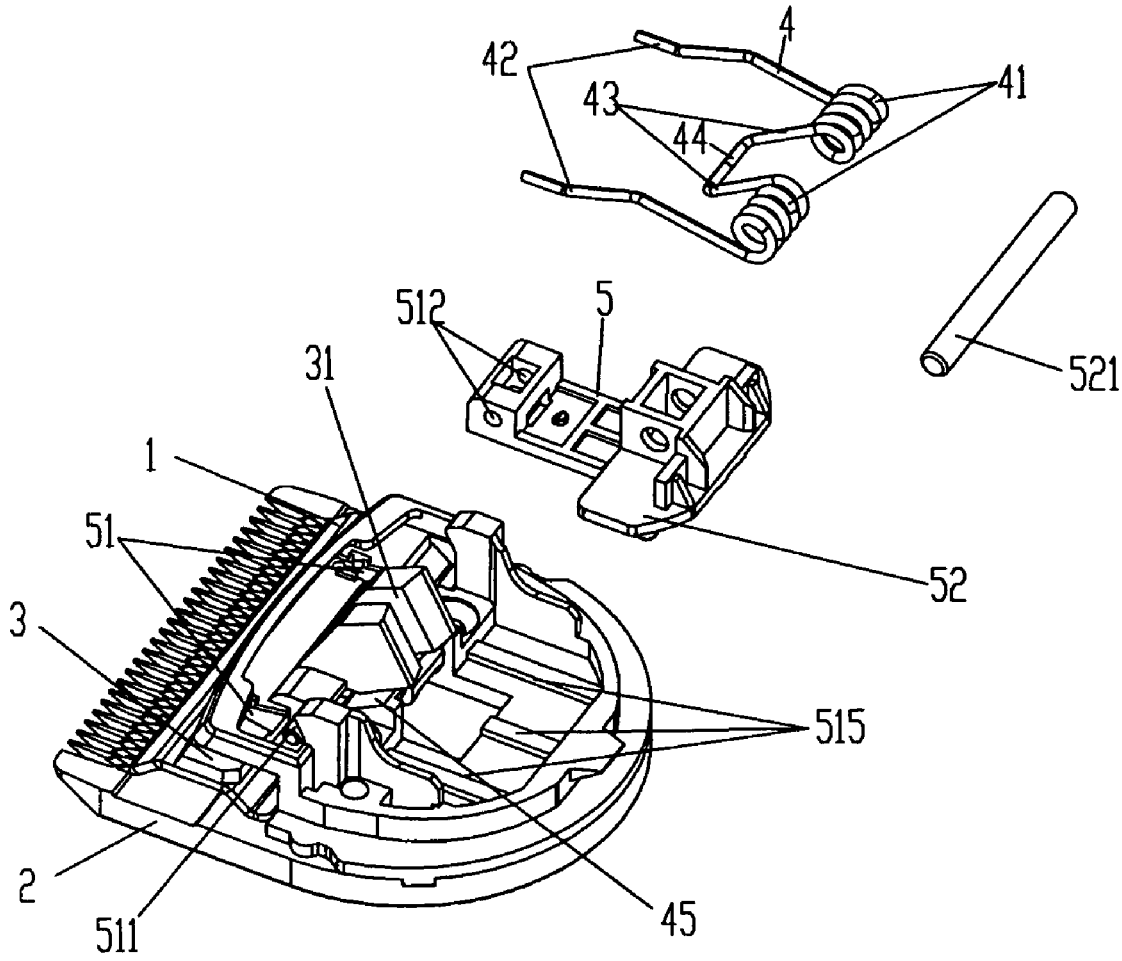
FIG. 4 is a disassembling view showing some of the components of the blade driving assembly of the present invention.
Figure 5:
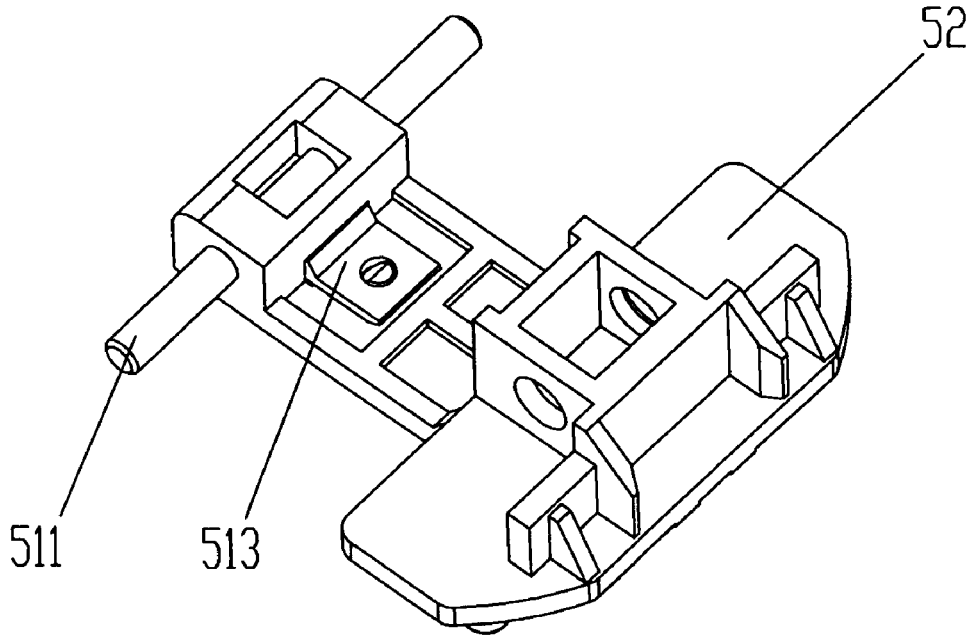
FIG. 5 is another perspective view showing some of the components of the blade driving assembly of the present invention.
Figure 6:
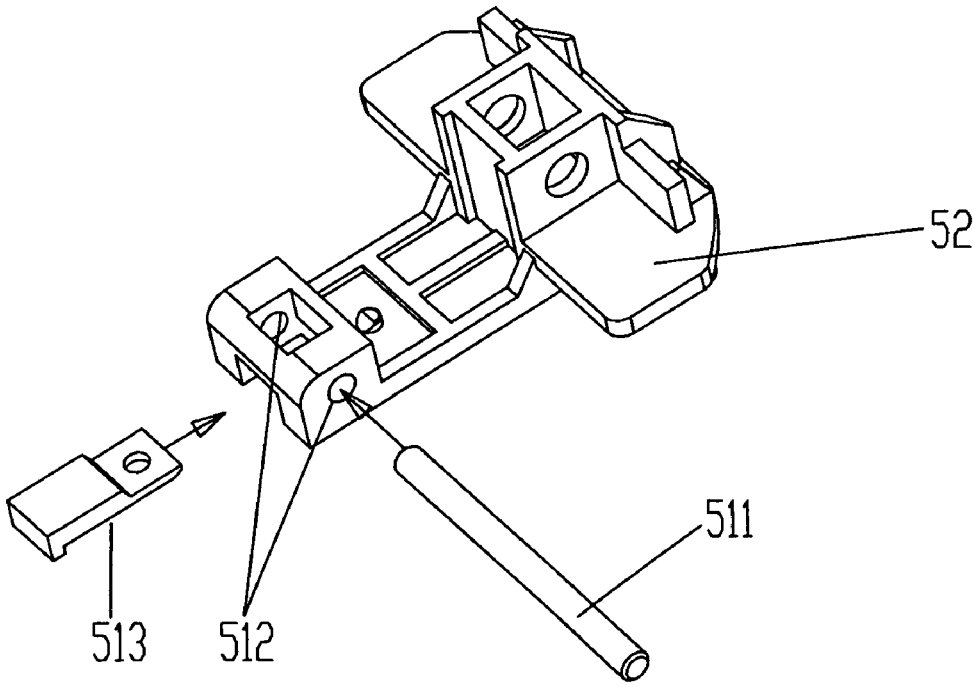
FIG. 6 is another disassembling view showing some of the components of the blade driving assembly of the present invention.

As illustrated in FIGS. 2 to 4, in this embodiment, the spring means 4 is a torsion spring disposed with a pair coiled portions 41 secured on the spring holder 5. Two segments 42 extending from outer ends of the coiled portions 41 exert pressure upon the movable blade holder 3 to bias the movable blade 1 towards the stationary blade 2. Two slots 51 are disposed on an upper surface of the movable blade holder 3 for receiving the two segments 42 thereon respectively. Two segments 43 extend from inner ends of the coiled portions 41 and the two segments 43 are joined by a joined segment 44. A stopper 45 is disposed rear to the movable blade holder 3 at a fixed position relative to the stationary blade 2 which cooperates with the joined segment 44 to bias the spring holder 5 towards a retracted position.

As illustrated in FIGS. 3 to 6, the spring holder 5 is disposed with a connecting means at a front end thereof and a securing means 52 at a rear end thereof for securing the coiled portion 41 of the spring means 4. In this embodiment, the connecting means of the spring holder comprises a driving shaft 511, a pair of through holes 512 arranged at the front end of the spring holder 5 for receiving a middle portion of the driving shaft 511, a locking tab 513 with its front end abutting against an underside of the driving shaft 511 and its rear end fastened to the spring holder 5 at a position rear to the pair of through holes 512, and a pair of hooked sections 514 disposed at the rear end of the movable blade holder 3 for receiving the driving shaft 511 with the pair of through holes 512 disposed therebetween in a way which allows the movable blade holder 3 to move in a lateral reciprocating manner along the driving shaft 511. The securing means 52 of the spring holder 5 comprises a rod 521 fastened thereto and through which the coiled portion 41 of the spring means 4 extends. A plurality of supporting ribs 515 are provided underneath the spring holder 5 to support forward and backward movements of the spring holder 5.

The push lever 6 is driven to move forward or backward by an external force, and a front end of the push lever 6 abuts against the rear end of the spring holder 5 in such a way to push the spring holder 5 forward when the push lever 6 is driven forward, and when the push lever 6 is driven backward, the spring holder 5 is biased by the spring means 4 to retract until the rear end thereof abuts against the push lever 6.

The present invention operates as follows:

When the blade driving assembly is at a default position, due to the biasing force exerted by the two segments 43 and the joined segment 44, the spring holder 5 is fixed at a retracted position.

If the user wishes to increase the cut length of hairs, the user pushes an adjustment knob on the hair clipper forward which in turn drives the push lever 6 to move forward. The forward driving force of the push lever 6 offsets the biasing force exerted by the two segments 43 and the joined segment 44 of the spring means 4 so that the spring holder 5 is driven to move forward. The movable blade holder 3 and the movable blade 1 are also driven to move forward by the connecting means of the spring holder 5.

If the user wishes to reduce the cut length of hairs, the user pulls the adjustment knob on the hair clipper backward which in turn drives the push lever 6 to move backward. The biasing force exerted by the two segments 43 and the joined segment 44 of the spring means 4 drive the spring holder 5 to retract until the rear end of the spring holder 5 abuts against the push lever 6. The movable blade holder 3 and the movable blade 1 are thereby driven to move backward by the connecting means of the spring holder 5.

The torsion spring 4 of the present invention is not responsible for the forward and backward movements of the movable blade holder 3. Instead, the forward and backward movements of the movable blade holder 3 are driven by the linear mechanical movements of the push lever 6 and the spring holder 5. It is therefore possible to ensure accurate adjustment of the cut length of hairs.

The above embodiment is a preferred embodiment of the present invention. The present invention is capable of other embodiments and is not limited by the above embodiment. Any other variation, decoration, substitution, combination or simplification, whether in substance or in principle, not deviated from the spirit of the present invention, is replacement or substitution of equivalent effect and falls within the scope of protection of the present invention.

What is claimed is:

1. A blade driving assembly for an adjustable hair clipper having a movable blade driven by the blade driving assembly to reciprocate laterally relative to a stationary blade in an operative condition, wherein the blade driving assembly comprises a movable blade holder fastened to the movable blade and disposed with a fastening slot, and the fastening slot engages with an eccentric pin driven by a motor to drive the movable blade holder and the movable blade to move in a lateral reciprocating manner;

a spring means with a coiled portion secured on a spring holder, a first portion which exerts pressure upon the movable blade holder to bias the movable blade towards the stationary blade and a second portion which biases the spring holder towards a retracted position;

the spring holder is disposed with a connecting means at a front end thereof and a securing means at a rear end thereof for securing the coiled portion of the spring means, and the connecting means interlocks with the movable blade holder in such a way to allow the movable blade holder to move in a lateral reciprocating manner; and a push lever which is driven to move forward or backward by an external force, and a front end of the push lever abuts against the rear end of the spring holder in such a way to push the spring holder forward when the push lever is driven forward, and when the push lever is driven backward, the spring holder is biased by the spring means to retract until the rear end thereof abuts against the push lever;

the connecting means of the spring holder comprises a driving shaft, a pair of through holes arranged at the front end of the spring holder for receiving a middle portion of the driving shaft, a locking tab with its front end abutting against an underside of the driving shaft and its rear end fastened to the spring holder at a position rear to the pair of through holes, and a pair of hooked sections disposed at the rear end of the movable blade holder for receiving the movable blade holder to move in a lateral reciprocating manner along the driving shaft.

2. The blade driving assembly for an adjustable hair clipper as in claim 1, wherein the securing means of the spring holder comprises a rod fastened thereto and through which the coiled portion of the spring means extends.

3. The blade driving assembly for an adjustable hair clipper as in claim 1, wherein the spring means is a torsion spring, and the coiled portion takes the form of a pair of coiled portions, and the first portion of the spring means is formed by two segments each extending from outer ends of the coiled portions.

4. The blade driving assembly for an adjustable hair clipper as in claim 3, wherein two slots are disposed on an upper surface of the movable blade holder for receiving the two segments forming the first portion of the spring means thereon respectively.

5. The blade driving assembly for an adjustable hair clipper as in claim 1, wherein the spring means is a torsion spring, and the coiled portion takes the form of a pair of coiled portions, and the second portion of the spring means is formed by two segments each extending from inner ends of the coiled portions and a joined segment joining the two segments, and a stopper is disposed rear to the movable blade holder at a fixed position relative to the stationary blade which cooperates with the joined segment to bias the spring holder towards a retracted position.

6. The blade driving assembly for an adjustable hair clipper as in claim 1, wherein a plurality of supporting ribs are provided underneath the spring holder to support forward and backward movements of the spring holder.

* * * * *